US011427284B1

(12) United States Patent
Lieb

(10) Patent No.: US 11,427,284 B1
(45) Date of Patent: Aug. 30, 2022

(54) PERSONAL WATERCRAFT HULL

(71) Applicant: BOMBARDIER RECREATIONAL PRODUCTS INC., Valcourt (CA)

(72) Inventor: Lonnie Lieb, West Melbourne, FL (US)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 26 days.

(21) Appl. No.: 16/861,047

(22) Filed: Apr. 28, 2020

Related U.S. Application Data

(60) Provisional application No. 62/840,823, filed on Apr. 30, 2019.

(51) Int. Cl.
*B63B 1/04* (2006.01)
*B63B 3/38* (2006.01)
*B63B 34/10* (2020.01)

(52) U.S. Cl.
CPC ..... *B63B 1/042* (2013.01); *B63B 3/38* (2013.01); *B63B 34/10* (2020.02)

(58) Field of Classification Search
CPC ..... B63B 1/042; B63B 3/38; B63B 34/10; B63B 1/32; B63B 2001/325
See application file for complete search history.

(56) References Cited

U.S. PATENT DOCUMENTS

| | | | | |
|---|---|---|---|---|
| D326,839 | S | 6/1992 | Lapointe | |
| 5,588,388 | A | 12/1996 | Maruyama et al. | |
| 6,318,286 | B1 | 11/2001 | Nakashima et al. | |
| 6,332,422 | B1 | 12/2001 | Laroche | |
| 6,412,434 | B1 | 7/2002 | Kaneko | |
| 6,675,736 | B1 | 1/2004 | Schreiber et al. | |
| 6,863,015 | B2 | 3/2005 | Nakajima | |
| D513,399 | S | 1/2006 | Plumb | |
| D516,993 | S | 3/2006 | Bucaccio et al. | |
| D523,388 | S | 6/2006 | Plumb | |
| 7,240,632 | B1 | 7/2007 | Wynne et al. | |
| 7,958,838 | B1 | 6/2011 | Larose et al. | |
| 8,210,116 | B2 | 7/2012 | Campbell et al. | |
| 8,579,360 | B2 * | 11/2013 | Litchfield | B62D 35/001 296/180.4 |
| 8,915,206 | B1 | 12/2014 | Herrington et al. | |
| D732,457 | S | 6/2015 | Cote et al. | |
| 9,834,267 | B1 * | 12/2017 | Hanagan | B62J 17/00 |
| 10,086,908 | B2 | 10/2018 | Kato et al. | |
| 10,106,225 | B1 | 10/2018 | Massicotte et al. | |
| 10,173,751 | B1 | 1/2019 | Ratlieff | |

(Continued)

FOREIGN PATENT DOCUMENTS

| | | | | |
|---|---|---|---|---|
| CA | 3050216 A1 * | 1/2020 | | B64C 35/00 |
| WO | WO-2010109252 A2 * | 9/2010 | | F15D 1/005 |

*Primary Examiner* — Anthony D Wiest
(74) *Attorney, Agent, or Firm* — BCF LLP

(57) ABSTRACT

A personal watercraft hull has a bow, a keel, starboard and port upper edges, a starboard portion extending between the keel and the starboard upper edge, a port portion extending between the keel and the starboard upper edge, and a transom. The starboard portion has a starboard row of grooves. The port portion has a port row of grooves. The rows of grooves extend in a longitudinal direction and are laterally offset from the longitudinal centerline and from their corresponding upper edge. The grooves of the rows of grooves define recesses in an outer surface of the hull. A personal watercraft having the personal watercraft hull is also disclosed.

21 Claims, 12 Drawing Sheets

(56) References Cited

U.S. PATENT DOCUMENTS

| | | | | |
|---|---|---|---|---|
| D865,634 | S | 11/2019 | Spade et al. | |
| 2006/0066132 | A1* | 3/2006 | Page ..... | B62D 35/00 296/181.1 |
| 2011/0265705 | A1 | 11/2011 | Spade et al. | |
| 2012/0042820 | A1 | 2/2012 | Brekke | |
| 2014/0373739 | A1 | 12/2014 | Demirer | |
| 2014/0373769 | A1 | 12/2014 | Spade et al. | |

* cited by examiner

PERSONAL WATERCRAFT HULL

CROSS-REFERENCE

The present application claims priority to U.S. Provisional Patent Application No. 62/840,823, filed Apr. 30, 2019, the entirety of which is incorporated herein by reference

TECHNICAL FIELD à

The present technology relates to personal watercraft hull.

BACKGROUND

Personal watercraft hulls are provided with various features such as chines and strakes to assist in their stability when the personal watercraft are in motion.

Personal watercraft often lean into the turn when being steered (i.e. tilt right when turning right and tilt left when turning left). The shape of the hull and the arrangement and geometry of strakes and chines of the hull assist in maintaining stability.

Although the shape of the hull, the arrangement and geometry of strakes and chines, and sponsons provided near the stern on either side of the hull contribute to the stability of a personal watercraft in in motion, including while turning, there is a desire for a watercraft hull with features contributing to stability during turns.

SUMMARY

It is an object of the present technology to ameliorate at least some of the inconveniences present in the prior art.

The present technology provides a personal watercraft hull having starboard and port regions defining recesses. These regions extend in a longitudinal direction of the hull and are offset from a longitudinal centerline of the hull. In one embodiment, the starboard and port regions defining recesses are starboard and port rows of grooves. When the personal watercraft makes a turn, the flow of water under the region of recesses located on the side of the hull corresponding to the inside of the turn creates a low pressure region. This low pressure results in a downward force being applied on the side of the hull corresponding to the inside of the turn, thereby assisting in having the personal watercraft leaning into the turn.

According to one aspect of the present technology, there is provided a personal watercraft hull having a bow; a keel extending along a longitudinal centerline of the hull; a starboard upper edge disposed on a right side of a longitudinal vertical plane containing the longitudinal centerline; a starboard portion extending between the keel and the starboard upper edge; a port upper edge disposed on a left side of the longitudinal vertical plane; a port portion extending between the keel and the starboard upper edge; and a transom disposed between the starboard and port portions at a stern of the hull. The starboard portion has a starboard row of grooves. The starboard row of grooves extends in a longitudinal direction. The starboard row of grooves is laterally offset from the longitudinal centerline and from the starboard upper edge. The grooves of the starboard row of grooves define recesses in an outer surface of the hull. The port portion has a port row of grooves. The port row of grooves extends in the longitudinal direction. The port row of grooves is laterally offset from the longitudinal centerline and from the port upper edge. The grooves of the port row of grooves define recesses in the outer surface of the hull.

The hull has a length ranging from 2 meters to 4 meters, a beam ranging from 0.75 meters to 1.5 meters, and a depth ranging from 0.25 meters to 1 meter.

In some embodiments, the starboard and port rows of grooves are laterally offset from the keel.

In some embodiments, for each of the starboard and port rows of grooves, the row has: a laterally inner side disposed at a first lateral distance from the longitudinal centerline; and a laterally outer side disposed at a second lateral distance from the longitudinal centerline. The first lateral distance is at least 10 percent of the beam. The second lateral distance is less than 40 percent of the beam.

In some embodiments, the first lateral distance is at least 15 percent of the beam, and the second lateral distance is less than 35 percent of the beam.

In some embodiments, the first lateral distance is at least 18 percent of the beam, and the second lateral distance is less than 26 percent of the beam.

In some embodiments, each of the starboard and port rows has a width ranging from 2.5 percent to 30 percent of the beam.

In some embodiments, the width of each of the starboard and port rows ranges from 5 percent to 10 percent of the beam.

In some embodiments, the width of each of the starboard and port rows is about 7.5 percent of the beam.

In some embodiments, each of the starboard and port rows has a row length ranging from 15 percent to 75 percent of the length of the hull.

In some embodiments, the row length ranges from 20 percent to 50 percent of the length of the hull.

In some embodiments, the row length is about 27 percent of the length of the hull.

In some embodiments, for each of the starboard and port rows of grooves, the row has: a rear end disposed at a first longitudinal distance from the transom; and a front end disposed at a second longitudinal distance from the transom. The first longitudinal distance is at least 10 percent of the length of the hull. The second longitudinal distance is less than 90 percent of the length of the hull.

In some embodiments, the second longitudinal distance is less than 60 percent of the length of the hull.

In some embodiments, the second longitudinal distance is at least 40 percent of the length of the hull.

In some embodiments, the first longitudinal distance is at least 20 percent of the length of the hull; and the second longitudinal distance is at least 50 percent of the length of the hull.

In some embodiments, one of the starboard and port rows of grooves is on a wetted surface of the hull when the hull is tilted for making a turn.

In some embodiments, each groove of the starboard and port rows of grooves has a proximal end and a distal end, the proximal end being closer to the longitudinal centerline than the distal end. For at least some grooves of each of the starboard and port rows of grooves the distal ends are disposed longitudinally forward of their corresponding proximal ends.

In some embodiments, for each groove of each of the starboard and port rows of grooves, the distal end is disposed longitudinally forward its corresponding proximal ends.

In some embodiments, for each groove of the at least some grooves, a vertical plane containing the proximal and distal ends of the groove is at an angle ranging from 20 degrees to 60 degrees from the longitudinal vertical plane.

In some embodiments, the angle between the vertical plane containing the proximal and distal ends of the groove and the longitudinal vertical plane ranges from 30 degrees to 50 degrees.

In some embodiments, the angle between the vertical plane containing the proximal and distal ends of the groove and the longitudinal vertical plane is about 40 degrees.

In some embodiments, each groove has a maximum groove depth ranging from 1 mm to 5 mm. The maximum groove depth being measured from a line extending from a leading edge of the groove to trailing edge of the groove. The line being parallel to the longitudinal centerline. The maximum groove depth being measured in a direction normal to the line.

In some embodiments, the maximum groove depth ranges from 2 mm to 4 mm.

In some embodiments, the maximum groove depth is about 2.7 mm.

In some embodiments, for each of starboard and port rows of grooves, a longitudinal distance between leading edges of consecutive grooves is about 2.5 percent of the length of the hull.

In some embodiments, each groove has a maximum groove length being less than 1 percent of the length of the hull. The maximum groove length is measured from a leading edge of the groove to a trailing edge of the groove perpendicularly to the leading edge.

In some embodiments, for each groove, in a cross-section of the groove taken through a line extending between a leading edge of the groove and a trailing edge of the groove: the groove has a front surface extending from the leading edge to an apex; the groove has a rear surface extending from the apex to the trailing edge; and the front surface is steeper relative to the line than the rear surface.

In some embodiments, the starboard portion has a starboard strake located laterally between the keel and the starboard upper edge. The grooves of the starboard row of grooves are located at least in part laterally between the starboard strake and the starboard upper edge. The port portion has a port strake located laterally between the keel and the port upper edge. The grooves of the port row of grooves are located at least in part laterally between the port strake and the port upper edge.

In some embodiments, the starboard portion has a starboard chine located laterally between the starboard strake and the starboard upper edge. The grooves of the starboard row of grooves are located at least in part laterally between the starboard strake and the starboard chine. The port portion has a port chine located laterally between the port strake and the port upper edge. The grooves of the port row of grooves are located at least in part laterally between the port strake and the port chine.

In some embodiments, the grooves of the starboard row of grooves extend between the starboard strake and the starboard chine; and the grooves of the port row of grooves extend from the port strake to the port chine.

In some embodiments, the starboard chine is a first starboard chine. The starboard portion has a second starboard chine located laterally between the first starboard chine and the starboard upper edge. The port chine is a first port chine. The port portion has a second port chine located laterally between the first port chine and the port upper edge.

In some embodiments, the first starboard and port chines have a first radius of curvature. The second starboard and port chines have a second radius of curvature. The first radius of curvature is smaller than the second radius of curvature.

In some embodiments, the starboard portion has a starboard step laterally aligned with the starboard row of grooves. The starboard step is disposed rearward of the starboard row of grooves and extends to the transom. The port portion has a port step laterally aligned with the port row of grooves. The port step is disposed rearward of the port row of grooves and extends to the transom.

In some embodiments, the bow, the keel, the starboard portion, the port portion and the transom define a V-shaped hull.

According to another aspect of the present technology, there is provided a personal watercraft having a personal watercraft hull according to the above, a deck disposed on the personal watercraft hull, a straddle seat disposed on the deck, a motor disposed between the personal watercraft hull and the deck, and a marine propulsion system driven by the motor.

According to another aspect, there is provided a personal watercraft hull having: a bow; a keel extending along a longitudinal centerline of the hull; a starboard upper edge disposed on a right side of a longitudinal vertical plane containing the longitudinal centerline; a starboard portion extending between the keel and the starboard upper edge; a port upper edge disposed on a left side of the longitudinal vertical plane; a port portion extending between the keel and the starboard upper edge; and a transom disposed between the starboard and port portions at a stern of the hull. The starboard portion has a starboard region having recessed features. The starboard region extends in a longitudinal direction. The starboard region is laterally offset from the longitudinal centerline and from the starboard upper edge. The recessed features of the starboard region define recesses in an outer surface of the hull. The port portion has a port region having recessed features. The port region extends in the longitudinal direction. The port region is laterally offset from the longitudinal centerline and from the port upper edge. The recessed features of the port region define recesses in the outer surface of the hull. The hull has a length ranging from 2 meters to 4 meters, a beam ranging from 0.75 meters to 1.5 meters, and a depth ranging from 0.25 meters to 1 meter.

In some embodiments, the starboard and port regions of recessed features are laterally offset from the keel.

In some embodiments, for each of the starboard and port regions of recessed features, the region has: a laterally inner side disposed at a first lateral distance from the longitudinal centerline; and a laterally outer side disposed at a second lateral distance from the longitudinal centerline. The first lateral distance is at least 10 percent of the beam. The second lateral distance is less than 40 percent of the beam.

In some embodiments, the first lateral distance is at least 15 percent of the beam; and the second lateral distance is less than 35 percent of the beam.

In some embodiments, each of the starboard and port regions has a width ranging from 2.5 percent to 30 percent of the beam.

In some embodiments, the width of each of the starboard and port regions ranges from 5 percent to 10 percent of the beam.

In some embodiments, each of the starboard and port regions has a region length ranging from 15 percent to 75 percent of the length of the hull.

In some embodiments, the region length ranges from 20 percent to 50 percent of the length of the hull.

In some embodiments, for each of the starboard and port regions of recessed features, the region has: a rear end disposed at a first longitudinal distance from the transom;

and a front end disposed at a second longitudinal distance from the transom. The first longitudinal distance is at least 10 percent of the length of the hull. The second longitudinal distance is less than 90 percent of the length of the hull.

In some embodiments, the second longitudinal distance is less than 60 percent of the length of the hull.

In some embodiments, the second lateral distance is at least 40 percent of the length of the hull.

In some embodiments, the first longitudinal distance is at least 20 percent of the length of the hull; and the second longitudinal distance is at least 50 percent of the length of the hull.

In some embodiments, wherein one of the starboard and port rows of grooves is on a wetted surface of the hull when the hull is tilted for making a turn.

In some embodiments, the starboard portion has a starboard strake located laterally between the keel and the starboard upper edge. The recessed features of the starboard region of recessed features are located at least in part laterally between the starboard strake and the starboard upper edge. The port portion has a port strake located laterally between the keel and the port upper edge. The recessed features of the port region of recessed features are located at least in part laterally between the port strake and the port upper edge.

In some embodiments, the starboard portion has a starboard chine located laterally between the starboard strake and the starboard upper edge. The recessed features of the starboard region of recessed features are located at least in part laterally between the starboard strake and the starboard chine. The port portion has a port chine located laterally between the port strake and the port upper edge. The recessed features of the port region of recessed features are located at least in part laterally between the port strake and the port chine.

In some embodiments, the bow, the keel, the starboard portion, the port portion and the transom define a V-shaped hull.

According to another aspect, there is provided a personal watercraft having a personal watercraft hull according to the above, a deck disposed on the personal watercraft hull, a straddle seat disposed on the deck, a motor disposed between the personal watercraft hull and the deck, and a marine propulsion system driven by the motor.

For the purposes of this application, the term 'deadrise angle' refers to the angle formed between a portion of the hull and the horizontal when the hull is level. If the portion is curved, the deadrise angle is the average angle of that portion. The term 'chine' refers to the connection between two portions of the hull having different orientations. A chine is called 'reverse chine' when the chine protrudes from the hull downwardly with respect to a waterline. A chine is called 'flat chine' when the chine protrudes from the hull parallel to the waterline. The term 'hard chine' refers to a chine forming a sharp or a blunt edge with a small radius of curvature in the hull. The term 'soft chine' refers to a chine forming a blunt edge with a large radius of curvature in the hull. The term 'strake' refers to a protruding portion of the hull. The term 'keel' refers to a structural element located along a bottom central part of the hull. The term 'waterline' refers to the line on the hull of a watercraft where the water comes to, when the watercraft is unloaded, at rest and level. The term 'beam' refers to a width of the hull measured at its widest point. The term 'center of floatation' refers to the geometric center of the waterplane on which the hull floats. The term 'center of buoyancy' refers to the center of gravity of the volume of water displaced by the watercraft. The term 'wetted surface' refers to the surface of the hull below the waterline.

Embodiments of the present technology, each have at least one of the above-mentioned objects and/or aspects, but do not necessarily have all of them. It should be understood that some aspect of the present technology that have resulted from attempting to attain the above-mentioned objects may not satisfy these objects and/or may satisfy other objects not specifically recited herein.

Additional and/or alternative features, aspects, and advantages of the embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
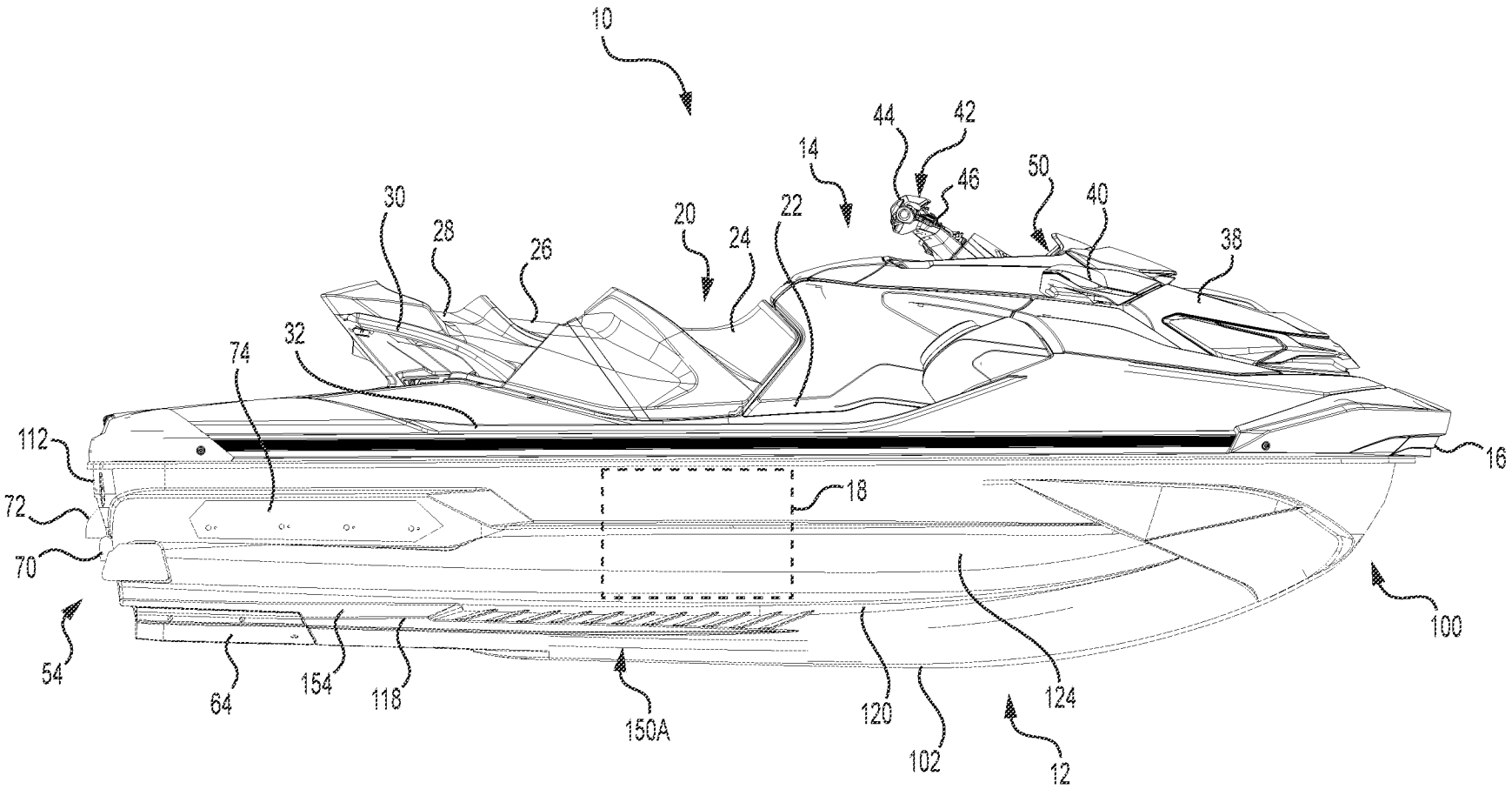
FIG. 1 illustrates a right side elevation view of a personal watercraft.
Figure 2:
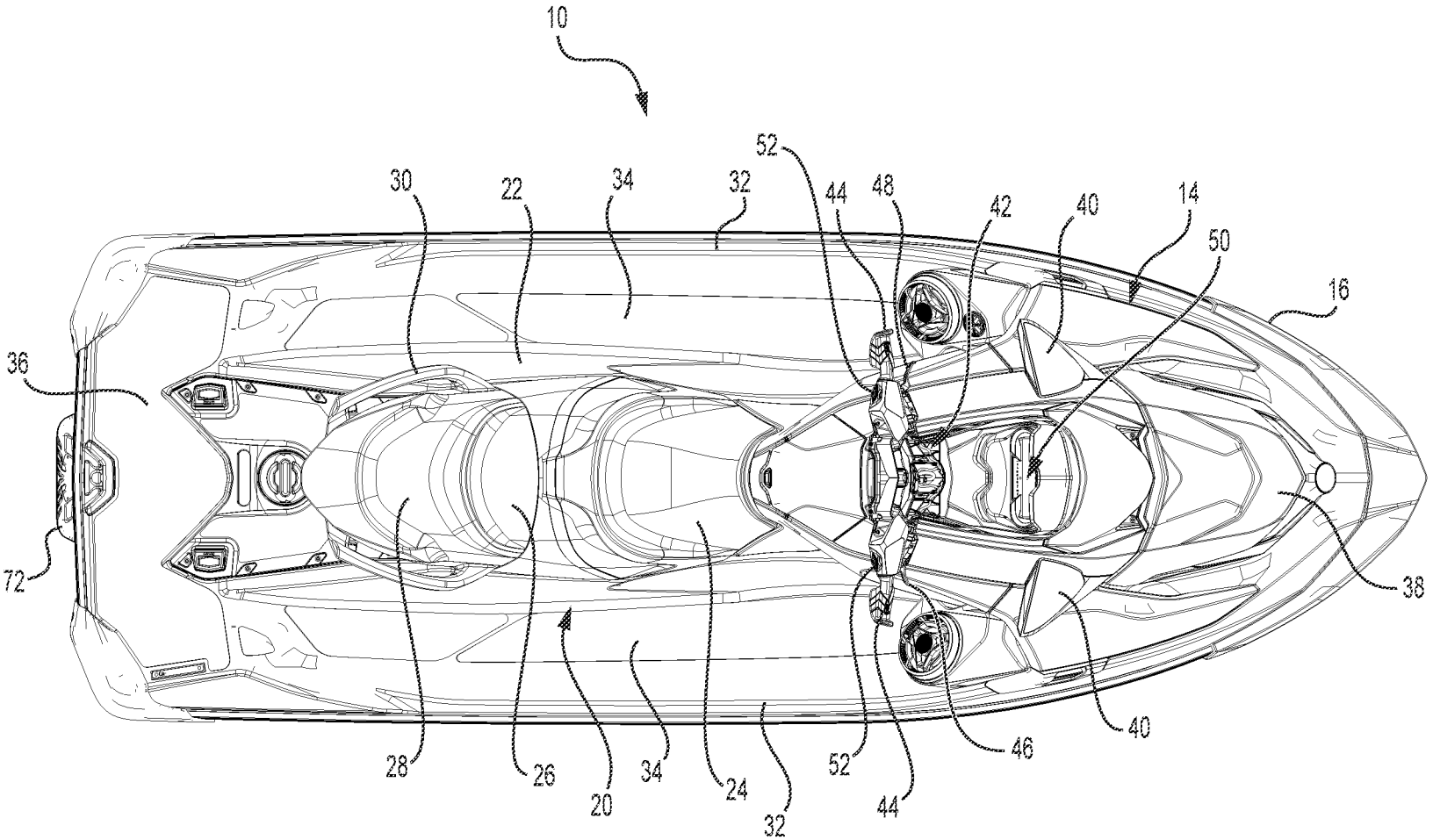
FIG. 2 is a top plan view of the watercraft of FIG. 1.

The general construction of a personal watercraft 10 in accordance with the present technology is shown in FIGS. 1 and 2. The following description relates to one way of manufacturing a personal watercraft. Those of ordinary skill in the watercraft art will recognize that there are other known ways of manufacturing and designing watercraft and that this technology would encompass these other known ways and designs.

The watercraft 10 of FIG. 1 has a hull 12 and a deck 14. The hull 12 buoyantly supports the watercraft 10 in the water. The deck 14 is designed to accommodate a driver and two passengers. It is contemplated that the deck 14 could be designed to accommodate only the driver, only the driver and one passenger, or the driver and more than two passengers. The hull 12 and deck 14 are joined together at a seam that joins the parts in a sealing relationship. The seam comprises a bond line formed by an adhesive. Other known joining methods could be used to sealingly engage the parts together, including but not limited to thermal fusion or fasteners such as rivets or screws. A bumper 16 generally covers the seam, which helps to prevent damage to the outer surface of the watercraft 10 when the watercraft 10 is docked, for example.

The space between the hull 12 and the deck 14 forms a volume referred to herein as the motor compartment. The motor compartment houses a motor, which in the present embodiment is an internal combustion engine 18 (shown schematically in FIG. 1). The motor compartment also houses a muffler, gas tank, electrical system (battery, electronic control unit, etc.), air box, storage bins, and other elements required or desirable in the watercraft 10. It is contemplated that the motor could be a different type of motor, such as an electric motor for example.

The deck 14 has a centrally positioned straddle seat 20 positioned on top of a pedestal 22 to accommodate the driver and two passengers in a straddling position. The seat 20 includes a front seat portion 24, a central seat portion 26, and a rear seat portion 28. The seat 20 is removably attached to the pedestal 22. The seat 20 covers an engine access opening defined by a top portion of the pedestal 22 to provide access to the engine 18. A grab handle 30 is provided between the pedestal 22 and the rear of the seat 20 to provide a handle onto which a passenger may hold.

The deck 14 has a pair of generally upwardly extending walls located on either side of thereof known as gunwales or gunnels 32. Located on both sides of the watercraft 10, between the pedestal 22 and the gunnels 32 are the footrests 34 (FIG. 2). The footrests 34 are designed to accommodate the riders' feet in various riding positions. A reboarding platform 36 (FIG. 2) is provided at the rear of the deck 14 to allow the rider or a passenger to easily reboard the watercraft 10 from the water.

The deck 14 is provided with a hood 38 located forward of the seat 20. The hood 38 is pivotally connected to allow the hood 38 to move to an open position to provide access to a storage bin (not shown). Rearview mirrors 40 are positioned on either side of the deck 14 forward of the seat 20 to allow the driver to see behind the watercraft 10.

A helm assembly 42 is positioned forward of the seat 20 and rearward of the hood 38. The helm assembly 42 has a pair of steering handles 44. The right steering handle 44 is provided with a throttle operator 46, which allows the driver to control the engine 18. The left steering handle 44 is provided with a lever 48 (FIG. 2) used by the driver to decelerate the watercraft 10 as described in greater detail below.

As seen in FIG. 2, a display cluster 50 is located forwardly of the helm assembly 42. The display cluster 50 can be of any display type, including a liquid crystal display (LCD), gauges, dials or LED (light emitting diodes). The helm assembly has various buttons 52, which could alternatively be in the form of levers or switches, that allow the driver to modify the display data or mode (speed, engine rpm, time . . . ) on the display cluster 50 or to change a condition of the watercraft 10, such as trim (i.e. the pitch of the watercraft 10).

Figure 3:
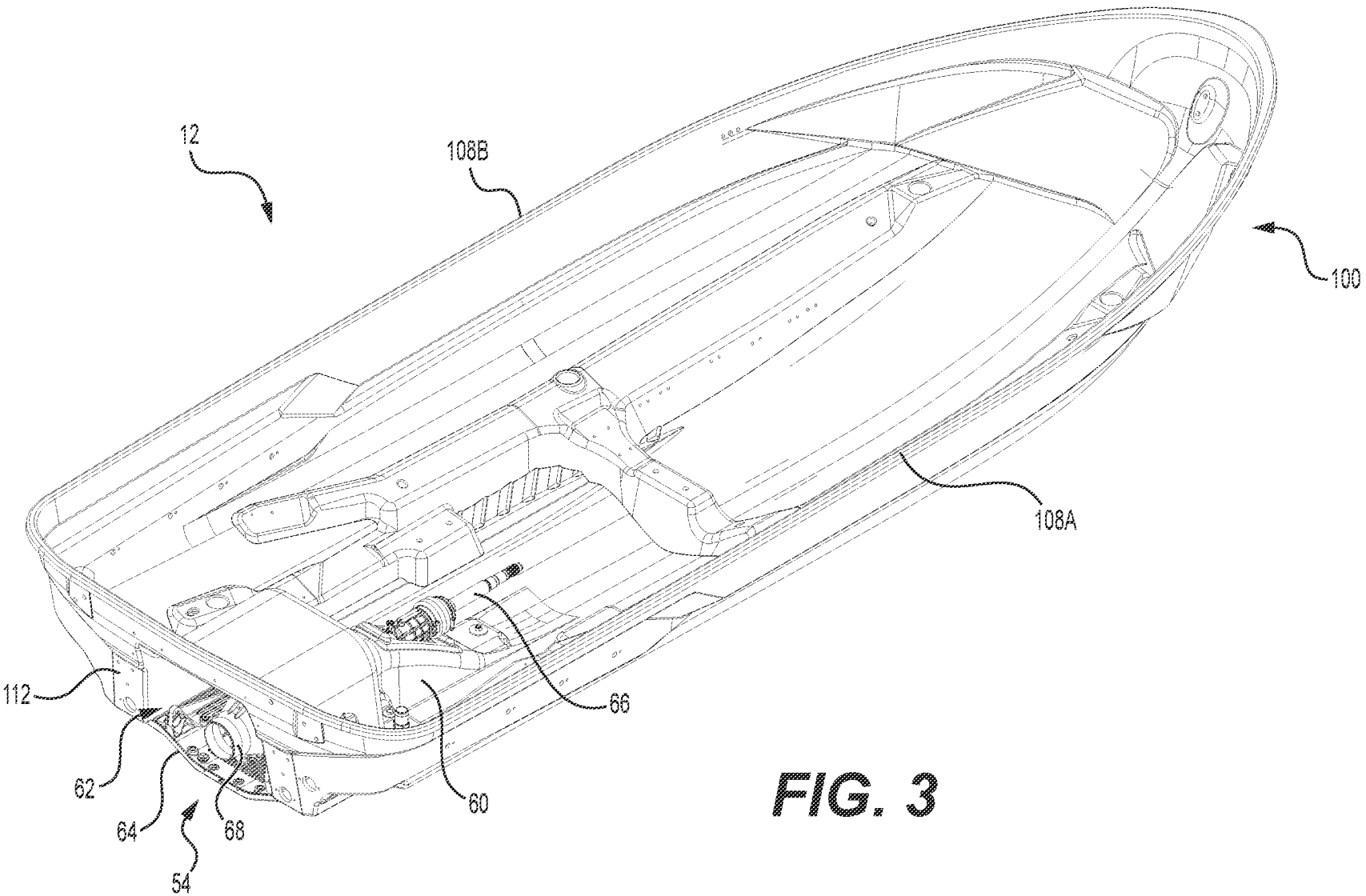
FIG. 3 is a perspective view taken from a rear, right side of a hull of the watercraft of FIG. 1.

The watercraft 10 is propelled by a jet propulsion system 54. It is contemplated that the watercraft 10 could be propelled by a marine propulsion system other than the jet propulsion system 54. The jet propulsion system 54 scoops water from under the hull 12 through an inlet 56, which has an inlet grate 58 (see FIG. 7). The inlet grate 58 prevents large rocks, weeds, and other debris from entering the jet propulsion system 54, which may damage the system or negatively affect performance. Water flows from the inlet 56 through a water intake ramp 60 (FIG. 3). The top portion of the water intake ramp 60 is formed by the hull 12, and a pump support (not shown), also known as a ride shoe, forms its bottom portion. Alternatively, the intake ramp 60 may be a single piece or an insert.

From the intake ramp 60, water enters a jet pump (not shown). The jet pump is located in a formation in the hull 12, referred to as the tunnel 62, and is mounted to the pump support. The tunnel 62 is defined at the front, sides, and top by the hull 12 and is open at the rear. The bottom of the tunnel 62 is closed by a ride plate 64. The ride plate 64 is attached to the bottom of the hull 12 and creates a surface on which the watercraft 10 rides or planes at high speeds. The jet pump includes an impeller (not shown) and a stator (not shown). The impeller is coupled to the engine 18 by an impeller shaft (not shown) and a driveshaft 66 (FIG. 3). Once the water leaves the jet pump, it goes through a venturi 68 (FIG. 3). A steering nozzle 70 (FIG. 1) is pivotally attached to the venturi 68 so as to pivot about a vertical axis. It is contemplated that the steering nozzle 70 could be replaced by a rudder or other diverting mechanism disposed at the exit of the tunnel 62 to selectively direct the thrust generated by the jet propulsion system 54 to effect turning. The steering nozzle 70 is operatively connected to the helm assembly 42 preferably via a push-pull cable (not shown) or via a steering-by-wire system. The steering nozzle 70 may be gimbaled to allow it to move about a horizontal pivot axis to permit trim which controls the pitch of the watercraft 10.

The watercraft 10 is provided with a reverse gate 72 which is movable between a stowed position (shown in FIGS. 1 and 2) where it does not interfere with the jet of water being expelled by the jet propulsion system 54 and a plurality of positions where it redirects the jet of water being expelled by the jet propulsion system 54. Actuating the lever 48 on the helm assembly 42 sends a signal to an actuator, such as an electric motor, to move the reverse gate 72 to a position where the jet of water is redirected to decelerate the watercraft 10 or to make the watercraft 10 move in a reverse direction. It is contemplated that the reverse gate 72 could be actuated differently.

Sponsons 74 (only a starboard one of which is shown in FIG. 1) are disposed on both sides of the hull 12 near the rear of the hull 12. It is contemplated that the sponsons 74 could be optional. The sponsons 77 have an undersurface that gives the watercraft 10 both lift while in motion and improved turning characteristics.

Turning now to FIGS. 2 to 10, an embodiment of the hull 12 will be described in greater detail.

The hull 12 has a bow 100 at a front thereof. A keel 102 extends along a longitudinal vertical plane 104 (FIG. 4) that contains a longitudinal centerline 106 (FIG. 7) of the hull 12. The hull 12 has a starboard upper edge 108A and a port upper edge 108B disposed on the right and left sides of the longitudinal vertical plane 104 respectively. A starboard portion 110A of the hull 12 extends between the keel 102 and the starboard upper edge 108A. Similarly, a port portion 110B of the hull 12 extends between the keel 102 and the port upper edge 108B. The hull 12 has a transom 112 at the stern thereof. The transom 112 is disposed between the starboard and port portions 110A, 110B of the hull 12. The bow 100, the keel 102, the starboard and port portions 110A, 110B, and the transom 112 define a hull of the type generally referred to as a V-shaped hull.

The hull 12 has a beam W (FIG. 4) of 1.10 meters, a length L (FIG. 6) of 3.25 meters, and a depth H (FIG. 5) of 0.45 meters. It is contemplated that the hull 12 could have a beam W ranging from 0.75 meters to 1.5 meters, a length L ranging from 2 meters to 4 meters, and a depth H ranging from 0.25 meters to 1 meter.

The hull 12 is a double deadrise hull. As such, each of the starboard and port portions 110A, 110B has a sub-portion 114 and a sub-portion 116 each having a deadrise angle. As can be seen, the sub-portions 116 are disposed laterally outward of the sub-portions 114. In the present embodiment, the sub-portions 114, 116 have the same deadrise angle. It is contemplated that the deadrise angle of the sub-portions 114 could be different from the deadrise angle of the sub-portions 116. In one some embodiments, the sub-portions 114, 116 have deadrise angles ranging from 12 degrees to 25 degrees. In other embodiments, the sub-portions 114, 116 have deadrise angles ranging from 20 degrees to 25 degrees. In other embodiments, the sub-portions 114, 116 each have a deadrise angle of 22 degrees. It is contemplated that the hull 12 could be a single, triple, quadruple, or higher multiple deadrise hull.

Figure 4:
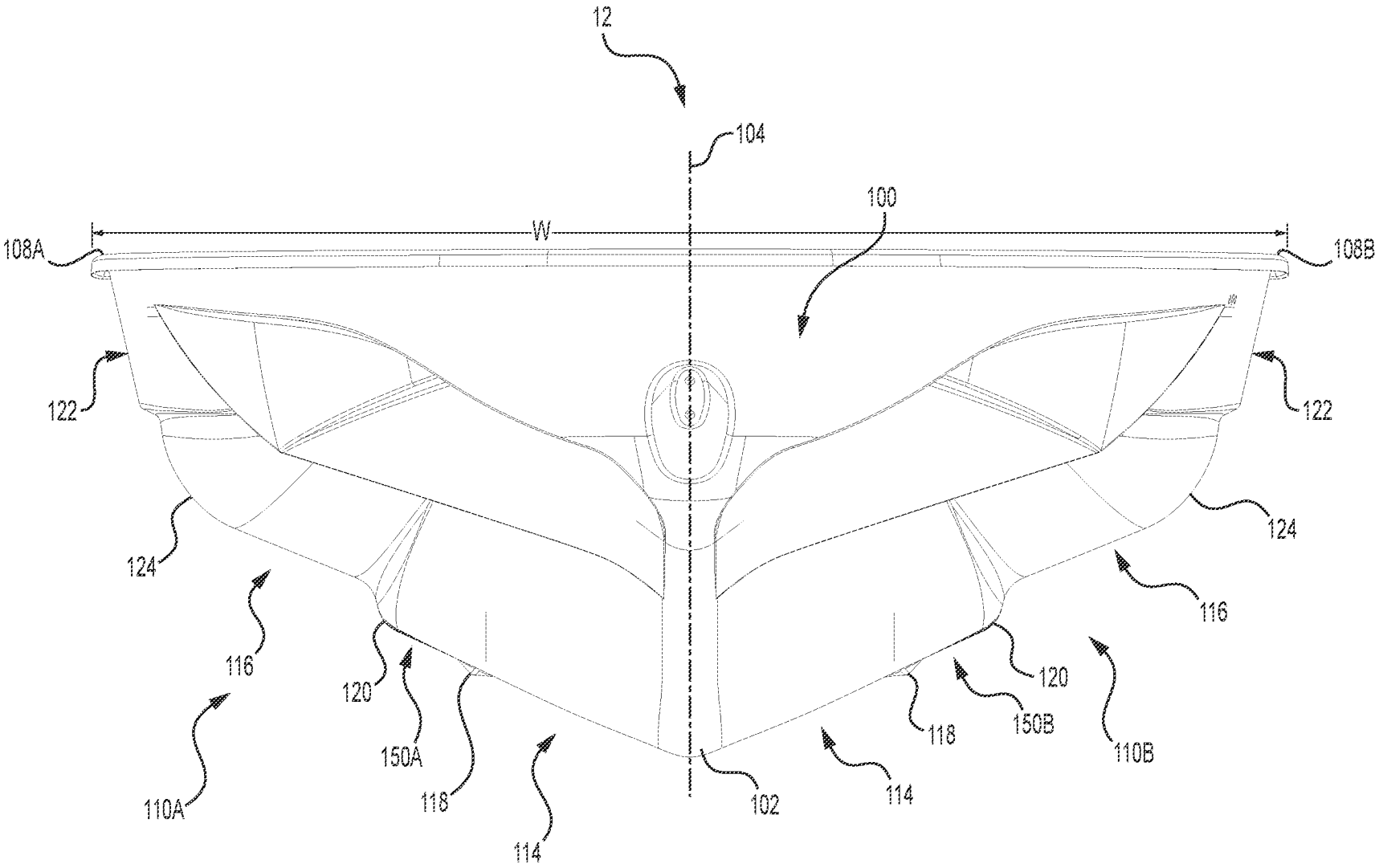
FIG. 4 is a front elevation view of the hull of FIG. 3.

With reference to FIG. 4, the port portion 110B has a port strake 118. The port strake 118 is located laterally between the keel 102 and the port upper edge 108B on the sub-portion 114. The port strake 118 has a triangular cross-section. It is contemplated that the port portion 110B could have more than one strake. It is contemplated that the port strake 118 could be longer or shorter than illustrated. It is also contemplated that the port strake 118 could have a different cross-sectional shape.

The sub-portion 114 connects to the sub-portion 116 of the port portion 110B via a port chine 120. The port chine 120 is located laterally between the strake 118 and the port upper edge 108B. The port chine 120 is a hard chine. It is contemplated that the chine 120 could be a soft chine. The sub-portion 116 connects to an upper sub-portion 122 of the port portion 110B of the hull 12 via a port chine 124. The port chine 124 is located laterally between the port chine 120 and the port upper edge 108B. The port chine 124 is a soft chine. As can be seen in FIG. 4, a radius of curvature of the port chine 120 is smaller than a radius of curvature of the port chine 124.

The hull 12 is symmetrical about the longitudinal vertical plane 104. As such, the starboard portion 110A has a starboard strake 118, a starboard chine 120 and a starboard chine 124 disposed symmetrically about the plane 104 relative to the port strake 118, the port chine 120 and the port chine 124 respectively. As such, the starboard strake 118 and the starboard chines 120, 122 will not be described in detail herein.

Figure 5:
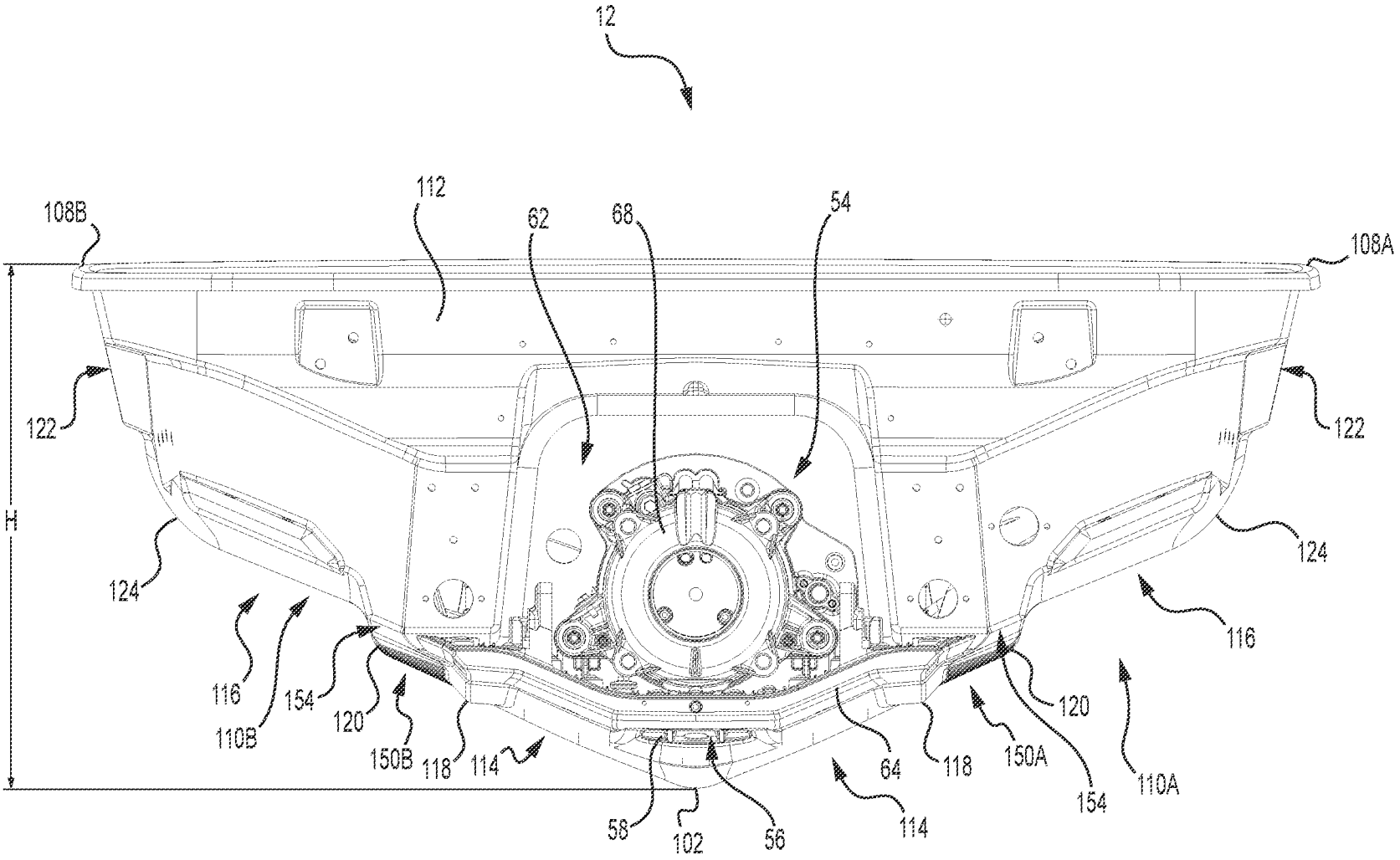
FIG. 5 is a rear elevation view of the hull of FIG. 3.
Figure 6:
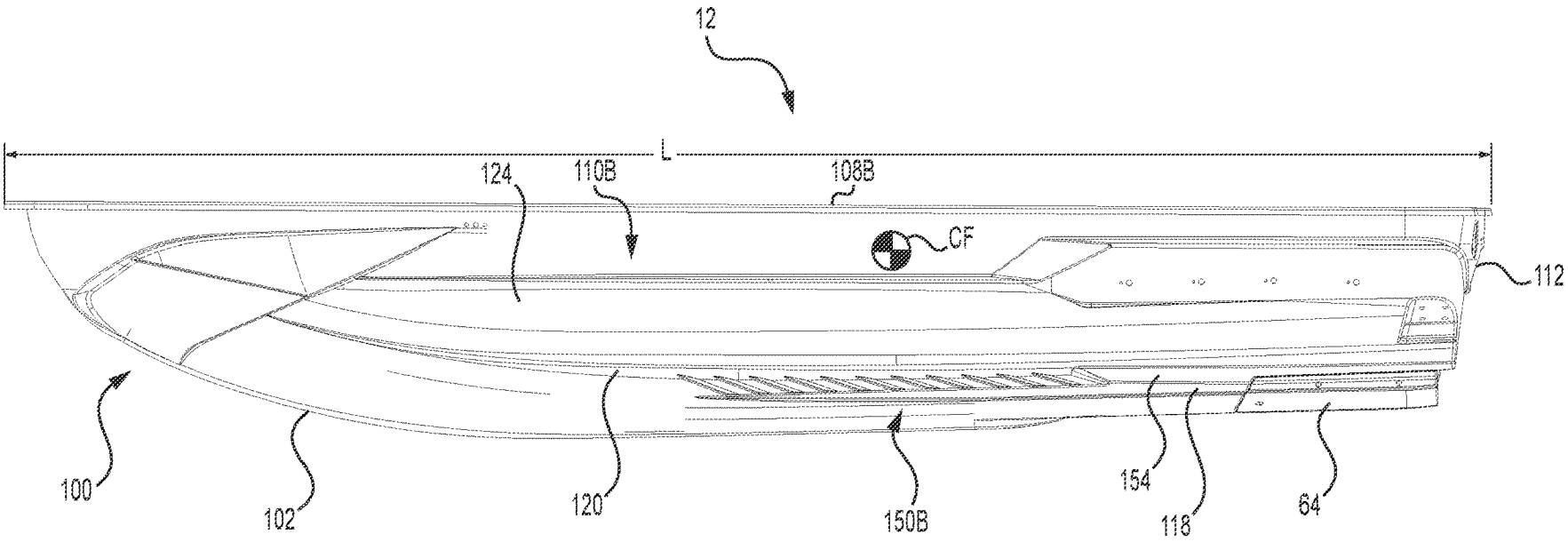
FIG. 6 is a left side elevation view of the hull of FIG. 3.
Figure 7:
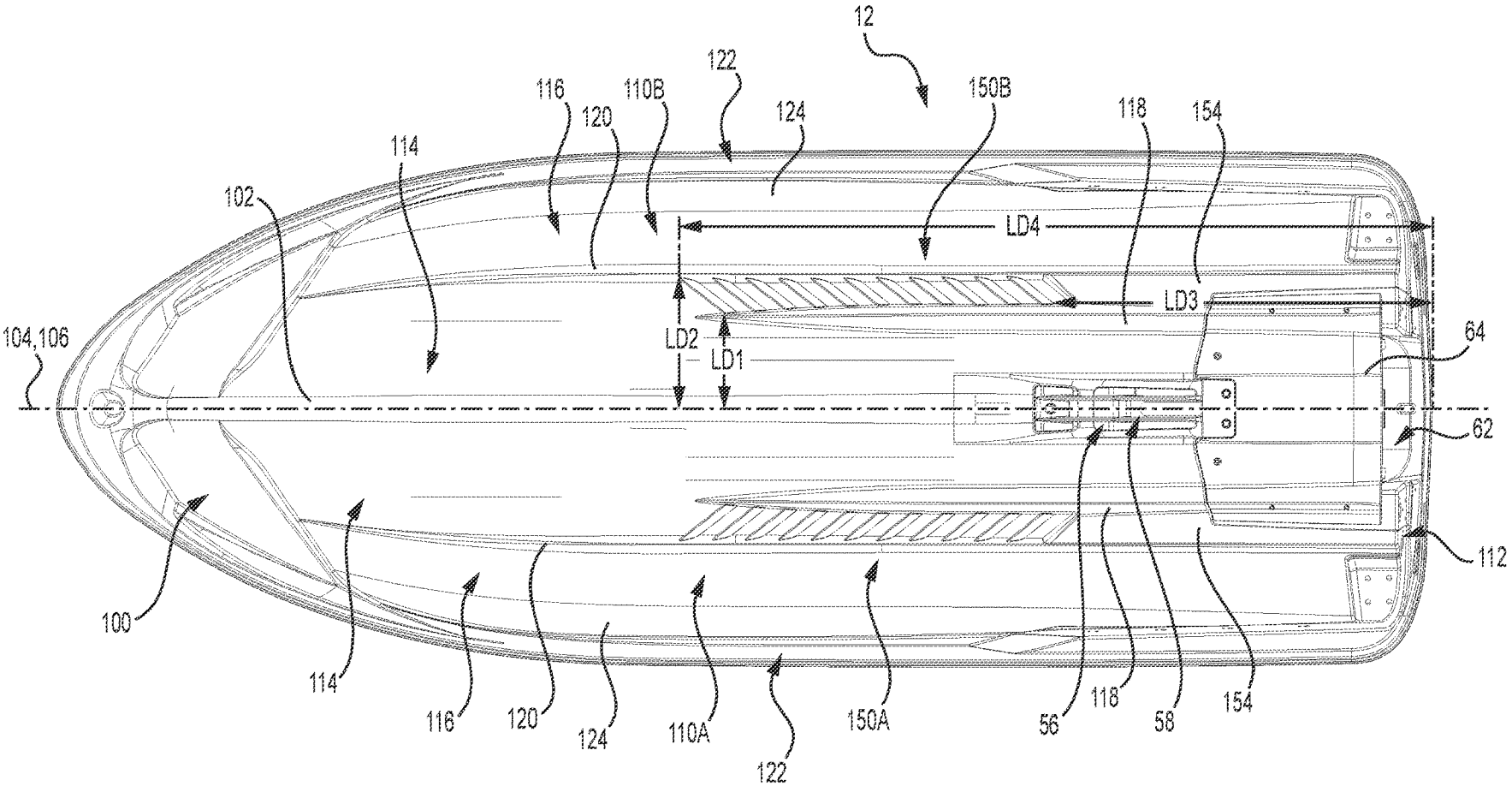
FIG. 7 is bottom plan view of the hull of FIG. 3.
Figure 8:
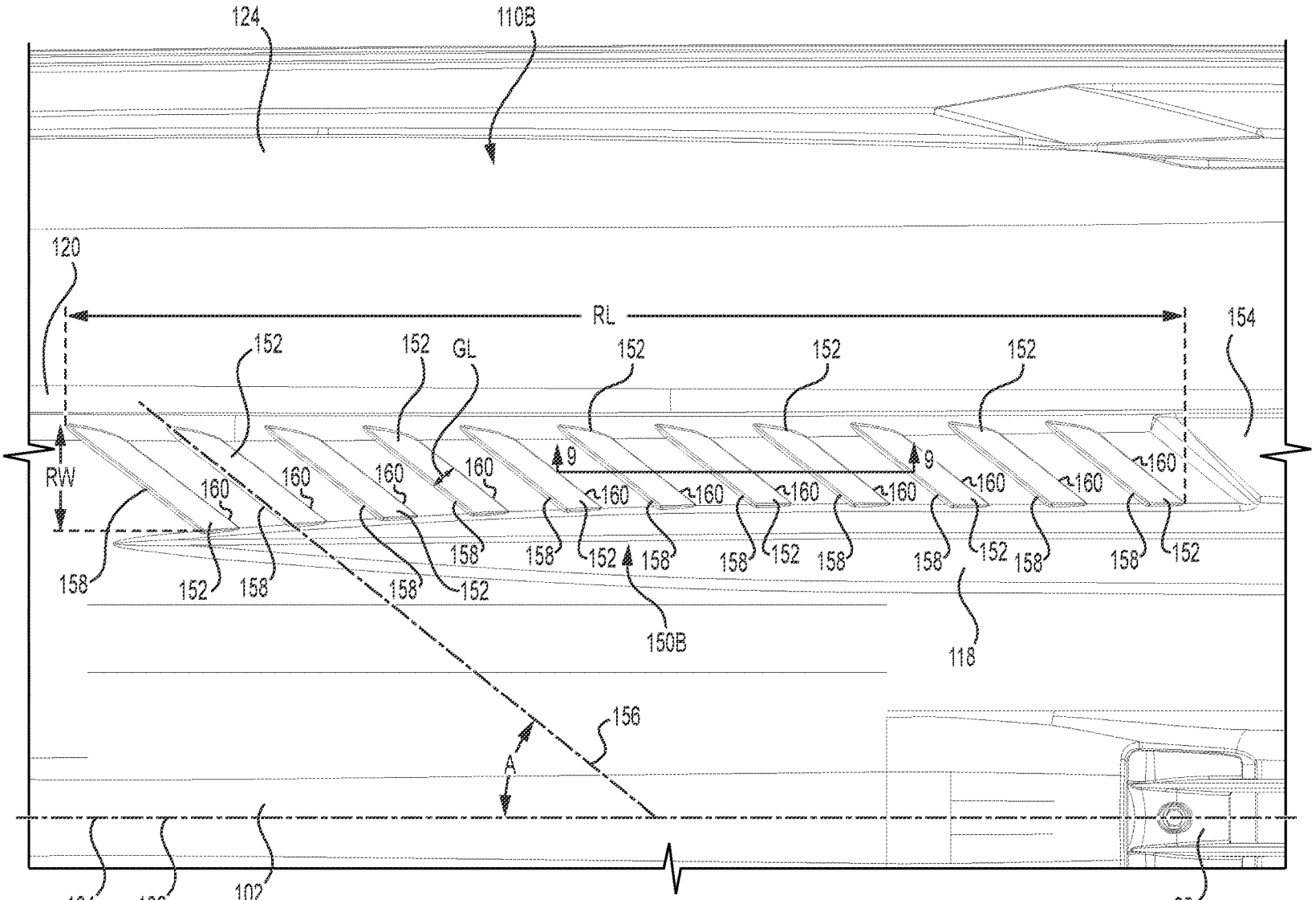
FIG. 8 is a close-up, bottom plan view of a left row of grooves of the hull of FIG. 3.

The starboard portion 110A has a starboard region 150A having recessed features 152. In the embodiment of the hull 12 illustrated in FIGS. 1 to 10, the starboard region 150A having recessed features 152 is a starboard row 150A of grooves 152 (i.e. the recessed features 152 are grooves 152). Similarly, the port portion 110B has a port region 150B having recessed features 152. In the embodiment of the hull 12 illustrated in FIGS. 1 to 10, the port region 150B having recessed features 152 is a port row 150B of grooves 152 (i.e. the recessed features 152 are grooves 152). The grooves 152 define recesses in the outer surface of the hull 12 as can best seen in FIG. 9. It is contemplated that in other embodiments, such as the embodiment illustrated in FIG. 11 which will be discussed in more detail below, the recessed features 152 could be features other than grooves. As can be seen in FIGS. 5 and 8, the starboard portion 110A has a recessed starboard step 154 that is disposed rearward of and is laterally aligned with the starboard row 150A of grooves 152. Similarly, the port portion 110B has a recessed port step 154 (FIGS. 5 and 6) that is disposed rearward of and is laterally aligned with the port row 150B of grooves 152. The starboard and port steps 154 extend to the transom 112. A width of the front end of the starboard and port steps 154 is similar to a width of the rear end of the rows 150A, 150B of grooves 152, as best seen in FIG. 8 for the port row 150B and the port step 154.

As the hull 12 is symmetrical about the longitudinal vertical plane 104, only the port row 150B of grooves 152 will be described in detail. The description of the port row 150B of grooves 152 should be understood as being applicable to the starboard row 150A of grooves 152, but with respect to the symmetrical arrangement of the starboard row 150 relative to the port row 150B about the longitudinal vertical plane 104. Although in the present embodiment, the starboard and port rows 150A, 150B are symmetrical, it is contemplated that this may not need to be the case.

As can be seen, the port row 150B of grooves 152 extends in the longitudinal direction along the port portion 110B. As can be seen in FIGS. 7 and 8, the port row 150B of grooves 152 is laterally offset from the longitudinal centerline 106 and from the port upper edge 108B. More specifically, the port row 150B of grooves 152 is laterally offset from the keel 102. In some embodiments, with reference to FIG. 7, the port row 150B of grooves 152 has a laterally inner side disposed at a lateral distance LD1 from the longitudinal centerline 106 that is at least 10 percent of the beam W and a laterally outer side disposed at a lateral distance LD2 from the longitudinal centerline 106 that is less than 40 percent of the beam W. In some embodiments, the lateral distance LD1 is at least 15 percent of the beam W and the lateral distance LD2 is less than 35 percent of the beam W. In some embodiments, the lateral distance LD1 is at least 18 percent of the beam W and the lateral distance LD2 is less than 26 percent of the beam W.

With reference to FIG. 8, the port row 150B of grooves 152 has a width RW ranging from 2.5 percent to 30 percent of the beam W. In some embodiments, the width RW ranges from 5 percent to 10 percent of the beam W. In some embodiments, the width RW is about 7.5 percent of the beam W (i.e. 7.5 percent+/−1 percent).

The port row 150B of grooves 152 is longitudinally spaced from both the bow 100 and the transom 112. As can be seen, the port row 150B of grooves 152 is closer to the transom 112 than to the bow 100. The rear end of the port row 150B of grooves 152 is longitudinally forward of the ride plate 64. The front end of the port row 150B of grooves 152 is disposed longitudinally forward of the front end of the strake 118 as best seen in FIG. 8. The port row 150B of grooves 152 is longitudinally located on the port portion 110B such that a center of floatation CF (FIG. 6) is disposed forward of the rear end of the port row 150B and rearward of the front end of the port row 150B. Although not shown, in some embodiments, the port row 150B of grooves 152 is longitudinally located on the port portion 110B such that the center of buoyancy and the center of gravity of the watercraft 10 are disposed forward of the rear end of the port row 150B and rearward of the front end of the port row 150B.

In some embodiments, with reference to FIG. 7, the rear end the port row 150B of grooves 152 is disposed at a longitudinal distance LD3 from the transom 112 that is at least 10 percent of the length L of the hull 12 and the front end the port row 150B of grooves 152 is disposed at a longitudinal distance LD4 from the transom 112 that is at less than 90 percent of the length L of the hull 12. In some embodiments, the longitudinal distance LD4 is less than 60 percent of the length L of the hull 12. In some embodiments, the longitudinal distance LD4 is at least 40 percent of the length L of the hull 112. In some embodiment, the longitudinal distance LD3 is at least 20 percent of the length L of the hull 12 and the longitudinal distance LD4 is at least 50 percent of the length L of the hull 12.

With reference to FIG. 8, the port row 150B of grooves 152 has a row length RL ranging from 15 percent to 75 percent of the length L of the hull 12. In some embodiments, the row length RL ranges from 20 percent to 50 percent of the length L of the hull 12. In some embodiments, the row length RL is about 27 percent of the length L of the hull 12 (i.e. 27 percent+/−2.5 percent).

As can be seen in FIG. 8, the grooves 152 extend laterally from the port strake 118 to the port chine 120. It is contemplated that in some embodiments, the grooves 152 could extend further inward and/or outward so as to be located at least in part laterally between the strake 118 and the port chine 120. It is contemplated that in some embodiments, the grooves 152 could extend further inward and/or outward so as to be located at least in part laterally between the strake 118 and the port upper edge 108B.

The grooves 152 extend at an angle A (FIG. 8) from the longitudinal vertical plane 104 such that, for each groove 152, the distal end of the groove 152 (i.e. the end that is furthest from the longitudinal vertical plane 104) is disposed longitudinally forward of the proximal end of the groove 152. The angle A is measured between a vertical plane 156 containing the proximal and distal ends of the groove 152 and the longitudinal vertical plane 104. In FIG. 8, the vertical plane 156 is parallel to a leading edge 158 of the groove 152. In the present embodiment, all of the grooves 152 extend at the same angle A to the longitudinal vertical plane 104, but it is contemplated that different grooves 152 could extend at different angles. For example, it is contemplated that the angle A could increase as the grooves 152 get closer to the transom 112. It is contemplated that the grooves 152 could also extend perpendicularly to the longitudinal vertical plane 104 or at an angle such that, for each groove 152, the distal end of the groove 152 is disposed longitudinally rearward of the proximal end of the groove 152. In some embodiments, the angle A ranges from 20 degrees to 60 degrees. In some embodiments, the angle A ranges from 30 degrees to 50 degrees. In some embodiments, the angle A is about 40 degrees (i.e. 40 degrees+/−2.5 degrees). In the present embodiment, as best seen in FIG. 8, the front end of the port step 154 extends at the same angle from the longitudinal vertical plane 104 as the grooves 152, but it is contemplated that this angle could be different. In the present embodiment, the angle A is selected to be perpendicular to the flow of water across rows 150A and 150B of the hull 12 during at least some operating conditions.

In the present embodiment, the grooves 152 are equally spaced from each other in a longitudinal direction of the hull 12. In some embodiments, the longitudinal distance P (FIG. 9) between leading edges 158 of consecutive grooves 152 is about 2.5 percent of the length L of the hull 12 (i.e. 2.5 percent+/−0.5 percent). Each groove 152 has a groove length GL (FIG. 8) that is less than 1 percent of the length L of the hull 12. The groove length GL is measured from the leading edge 158 of the groove 152 to the trailing edge 160 of the groove 152 perpendicularly to the leading edge 158. It is contemplated that is some embodiments, the groove length GL could be greater than or equal to 1 percent of the length L of the hull 12.

Figure 9:
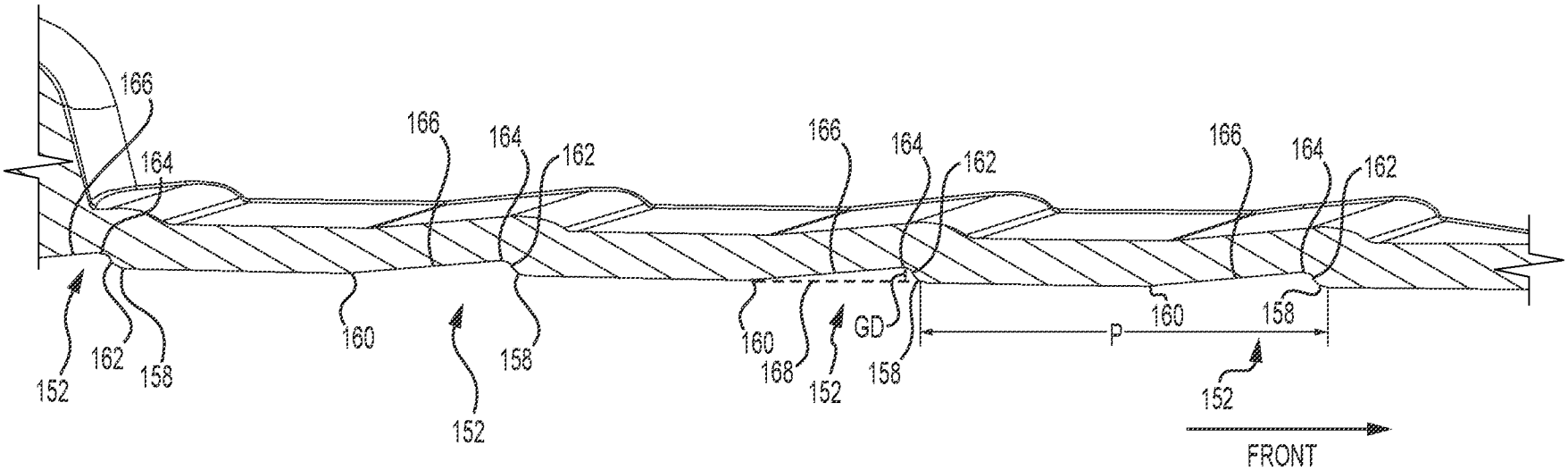
FIG. 9 is cross-sectional view of the hull of FIG. 3 taken along line 9-9 of FIG. 8.

With reference to FIG. 9, it can be seen that each groove 152 has a generally triangular cross-section. Each groove 152 has a front surface 162 extending from the leading edge 158 to an apex 164 of the groove 152 and a rear surface 166 extending from the apex 164 to the trailing edge 160. As can be seen, in the present embodiment, the front surface 162 is steeper and shorter than the rear surface 166. It is contemplated that the grooves 152 could have a different cross-sectional shape. It is also contemplated that at least some of the grooves 152 of the row 150B could have cross-sectional shapes that are different from each other. Each groove 152 has a groove depth GD (FIG. 9) that is measured from a line 168 to the apex 164 of the groove 152 in a direction normal to the line 168. The line 168 extends from the leading edge 158 to the trailing edge 160 of the groove 152 parallel to the longitudinal centerline 106. In some embodiments, the maximum groove depth GD of the grooves 152 ranges from 1 mm to 5 mm. In some embodiments, the maximum groove depth GD of the grooves 152 ranges from 2 mm to 4 mm. In some embodiments, the maximum groove depth GD of the grooves 152 is about 2.7 mm (i.e. 2.7 mm+/−0.3 mm). In some embodiments, the maximum groove depth 152 is selected so as to not be so deep that it would cause a flow of water over the row 150B to separate from the outer surface of the hull 12. Other maximum groove depths GD are contemplated. It is also contemplated that different grooves 152 could have different maximum groove depths GD.

Figure 10A:
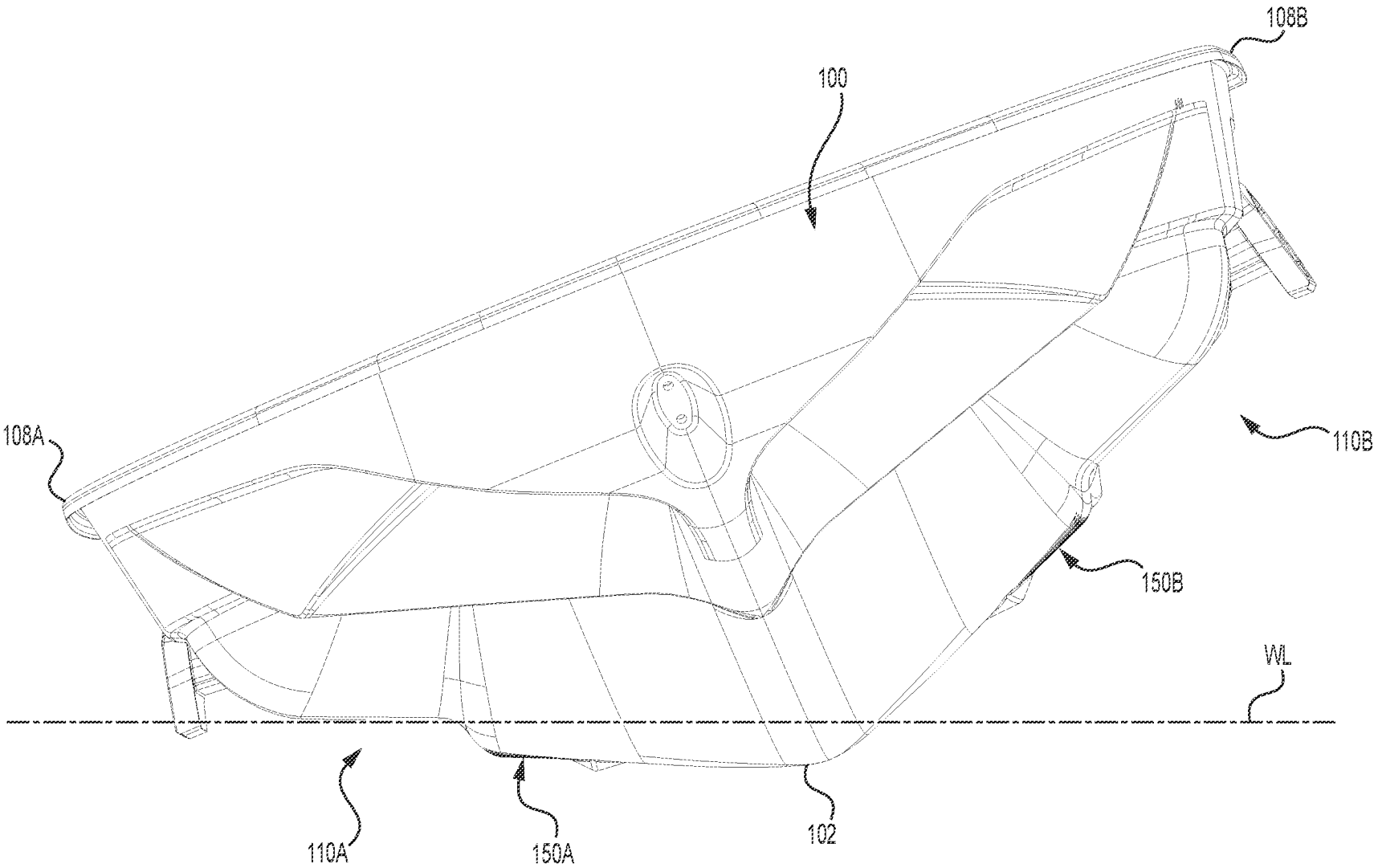
FIG. 10A is a front elevation view of the of the hull of FIG. 3, with the hull in an orientation corresponding to the watercraft making a starboard turn while moving forward.
Figure 10B:
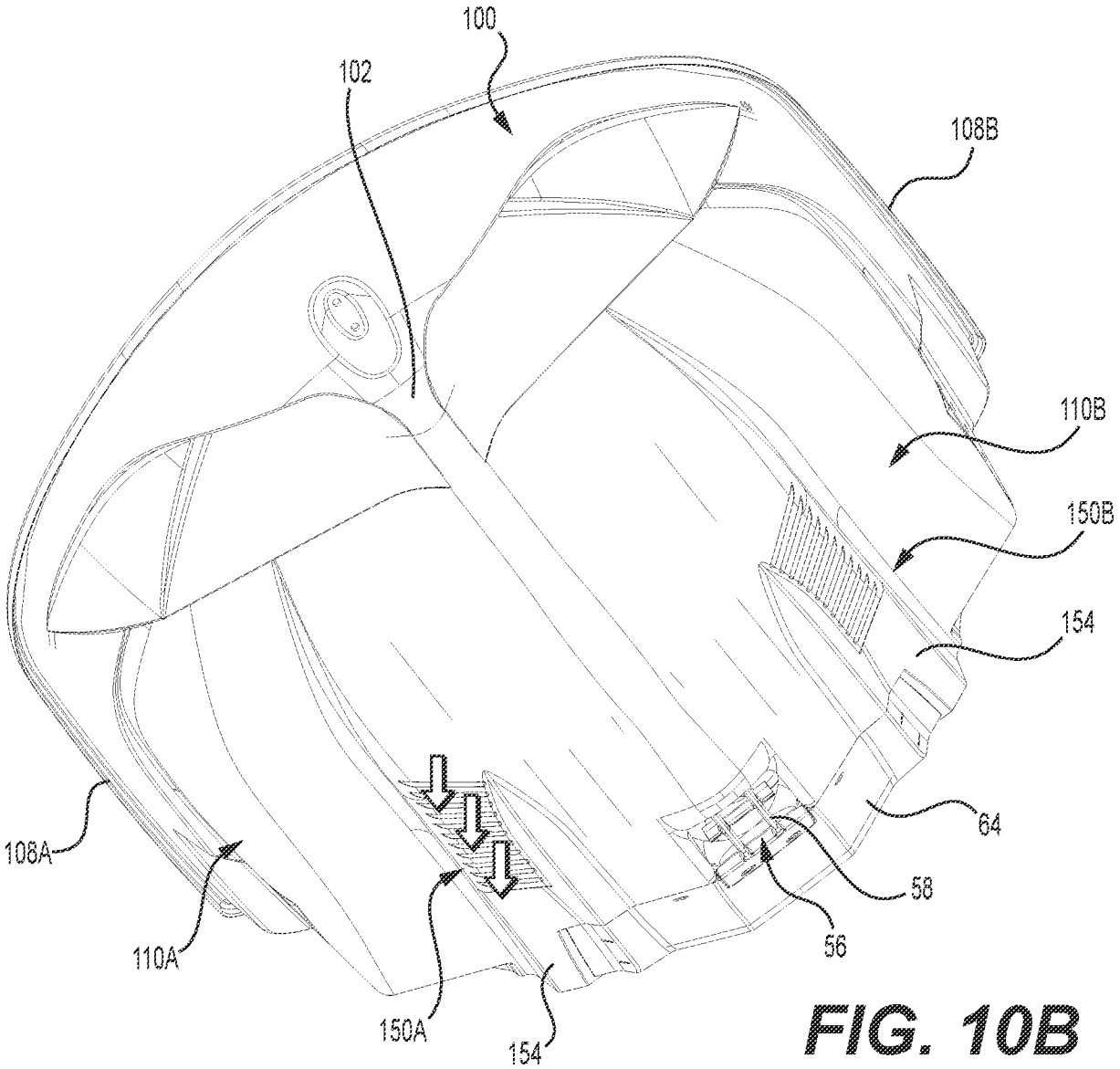
FIG. 10B is a perspective view taken from a bottom, front, left side of the turning hull of FIG. 10A.

During operation of the watercraft 10, the grooves 152 of the rows 150A, 150B create small areas of turbulence in the flow of water flowing over the rows 150A, 150B. These small areas of turbulence create a negative pressure (i.e. a pressure smaller than the pressure in adjacent areas) that results in a downward force being applied on the hull 12 at the location of the rows 150A, 150B. The rows 150A, 150B are located so that when the watercraft 10 makes a turn, a majority of the row 150A or 150B that is on the inside of the turn is on the wetted surface of the hull 100 (i.e. is in the water) so as to apply a downward force on the portion 110A or 110B of the hull 12, thereby enhancing turning of the watercraft 10. This is shown in FIGS. 10A and 10B for the hull 12 making a starboard turn. In FIG. 10A, the waterline is illustrated by the line WL, and the surface of the hull 100 below the waterline WL is the wetted surface. As can be seen in FIG. 10B, the angular orientation of the grooves 152 results in the flow of water over the row 150A (illustrated by bold arrows in FIG. 10B) being generally perpendicular to the leading edges 158 of the grooves 152 when making a starboard turn. When the watercraft 10 operates at high speed in a straight line, the bow 100 of the watercraft 10 is tilted up relative to the transom 112. As a result, in the present embodiment, the rows 150A, 150B of grooves 152 are out of the water, and therefore have little effect on the straight line operation of the watercraft 10.

The optimal position, dimensions, and shape of the rows 150A, 150B will depend on various factors, including, but not limited to, hull geometry, hull dimensions, hull features (strakes, chines, etc.), hull appendages (sponsons for example), the center of floatation, the center of buoyancy, the center of gravity and the desired amount of downward force to be applied by the interactions of the rows 150A, 150B with the flow of water over them.

Figure 11:
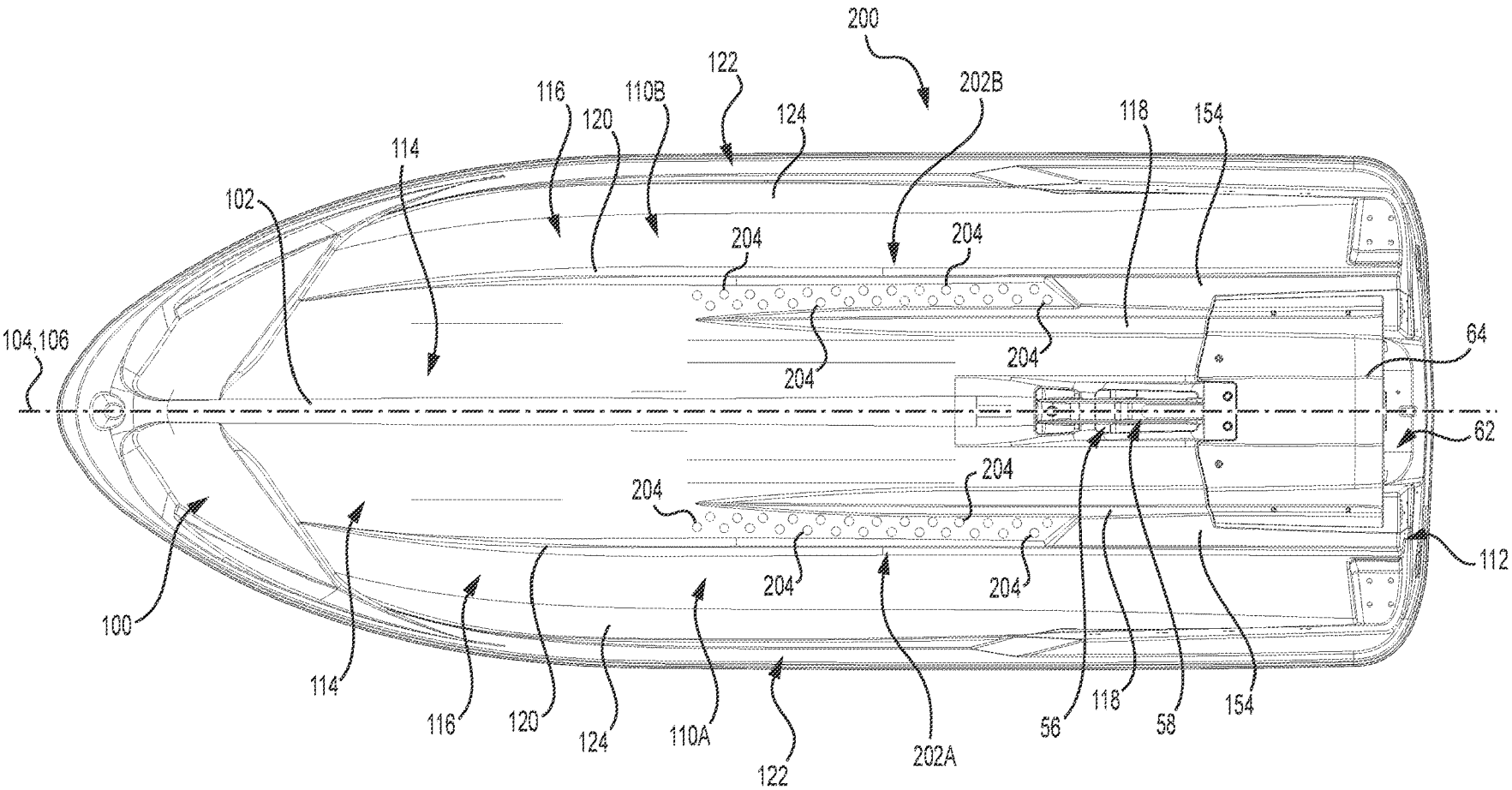
FIG. 11 is a bottom plan view of an alternative embodiment of the hull of the watercraft of FIG. 1.

Turning now to FIG. 11, a hull 200 which is an alternative embodiment of the hull 12 will be described. As the hull 200 has many features in common with the hull 12, these common features have been labelled with the same reference numerals and will not be described again. In the hull 200, the starboard and port rows 150A, 150B of grooves 152 have been replaced by starboard and port regions 202A, 202B of recessed features 204. More specifically, the recessed features 204 are dimples 204 (only some of which are labelled for clarity). As can be seen, in each region 202A, 202B, the dimples 204 are arranged in pairs, with each pair extending at an angle to the longitudinal center plane 104 of the hull 200. It is contemplated that the dimples 204 could be arranged differently and that there could be more or less dimples 204. Each dimple 204 has a diameter that is less than 1 percent of the length of the hull 200, but other diameters are contemplated. Each dimple 204 has a depth of about 2.7 mm (i.e. 2.7 mm+/−0.3 mm), but other depths are contemplated. The starboard and port regions 202A, 202B are located on the hull 200 in the same position as the starboard and port rows 150A, 150B on the hull 12. The starboard and port regions 202A, 202B also have a width and a region length corresponding to the width RW and the row length RL described above for the port row 150B. Like for the grooves 152, flow of water over the dimples 204 creates a low pressure region that creates a downward force that can enhance turning of a watercraft having the hull 200.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A personal watercraft hull comprising:
a bow;
a keel extending along a longitudinal centerline of the hull;
a starboard upper edge disposed on a right side of a longitudinal vertical plane containing the longitudinal centerline;
a starboard portion extending between the keel and the starboard upper edge,
the starboard portion having a starboard row of grooves,
the starboard row of grooves extending in a longitudinal direction,
the starboard row of grooves being laterally offset from the longitudinal centerline and from the starboard upper edge,
the grooves of the starboard row of grooves defining recesses in an outer surface of the hull;
a port upper edge disposed on a left side of the longitudinal vertical plane;
a port portion extending between the keel and the starboard upper edge;
the port portion having a port row of grooves,
the port row of grooves extending in the longitudinal direction,
the port row of grooves being laterally offset from the longitudinal centerline and from the port upper edge,
the grooves of the port row of grooves defining recesses in the outer surface of the hull; and
a transom disposed between the starboard and port portions at a stern of the hull;
the hull having:
a length ranging from 2 meters to 4 meters;
a beam ranging from 0.75 meters to 1.5 meters; and
a depth ranging from 0.25 meters to 1 meter;
for each of the starboard and port rows of grooves, the row having:
a laterally inner side disposed at a first lateral distance from the longitudinal centerline; and
a laterally outer side disposed at a second lateral distance from the longitudinal centerline;
the first lateral distance being at least 10 percent of the beam; and
the second lateral distance being less than 40 percent of the beam.

2. The personal watercraft hull of claim 1, wherein:
the first lateral distance is at least 15 percent of the beam; and
the second lateral distance is less than 35 percent of the beam.

3. The personal watercraft hull of claim 1, wherein each of the starboard and port rows of grooves has a width ranging from 2.5 percent to 30 percent of the beam.

4. The personal watercraft hull of claim 1, wherein each of the starboard and port rows of grooves has a row length ranging from 15 percent to 75 percent of the length of the hull.

5. The personal watercraft hull of claim 1, wherein, for each of the starboard and port rows of grooves, the row has:
a rear end disposed at a first longitudinal distance from the transom; and
a front end disposed at a second longitudinal distance from the transom;
wherein:
the first longitudinal distance is at least 10 percent of the length of the hull; and
the second longitudinal distance is less than 90 percent of the length of the hull.

6. The personal watercraft hull of claim 5, wherein the second longitudinal distance is less than 60 percent of the length of the hull.

7. The personal watercraft hull of claim 5, wherein the second longitudinal distance is at least 40 percent of the length of the hull.

8. The personal watercraft hull of claim 1, wherein one of the starboard and port rows of grooves is on a wetted surface of the hull when the hull is tilted for making a turn.

9. The personal watercraft hull of claim 1, wherein each groove has a maximum groove depth ranging from 1 mm to 5 mm, the maximum groove depth being measured from a line extending from a leading edge of the groove to trailing edge of the groove, the line being parallel to the longitudinal centerline, the maximum groove depth being measured in a direction normal to the line.

10. The personal watercraft hull of claim 9, wherein the maximum groove depth ranges from 2 mm to 4 mm.

11. The personal watercraft hull of claim 1, wherein, for each of starboard and port rows of grooves, a longitudinal distance between leading edges of consecutive grooves is about 2.5 percent of the length of the hull.

12. The personal watercraft hull of claim 1, wherein each groove has a maximum groove length being less than 1 percent of the length of the hull, the maximum groove length being measured from a leading edge of the groove to a trailing edge of the groove perpendicularly to the leading edge.

13. The personal watercraft hull of claim 1, wherein for each groove, in a cross-section of the groove taken through a line extending between a leading edge of the groove and a trailing edge of the groove:
the groove has a front surface extending from the leading edge to an apex;
the groove has a rear surface extending from the apex to the trailing edge; and
the front surface is steeper relative to the line than the rear surface.

14. The personal watercraft hull of claim 1, wherein:
the starboard portion has a starboard strake located laterally between the keel and the starboard upper edge;
the grooves of the starboard row of grooves are located at least in part laterally between the starboard strake and the starboard upper edge;

the port portion has a port strake located laterally between the keel and the port upper edge; and the grooves of the port row of grooves are located at least in part laterally between the port strake and the port upper edge.

15. The personal watercraft hull of claim 14, wherein:

the starboard portion has a starboard chine located laterally between the starboard strake and the starboard upper edge;

the grooves of the starboard row of grooves are located at least in part laterally between the starboard strake and the starboard chine;

the port portion has a port chine located laterally between the port strake and the port upper edge; and the grooves of the port row of grooves are located at least in part laterally between the port strake and the port chine.

16. A personal watercraft comprising:

a personal watercraft hull according to claim 1;

a deck disposed on the personal watercraft hull;

a straddle seat disposed on the deck;

a motor disposed between the personal watercraft hull and the deck; and a marine propulsion system driven by the motor.

17. A personal watercraft hull comprising:

a bow;

a keel extending along a longitudinal centerline of the hull;

a starboard upper edge disposed on a right side of a longitudinal vertical plane containing the longitudinal centerline;

a starboard portion extending between the keel and the starboard upper edge, the starboard portion having a starboard row of grooves, the starboard row of grooves extending in a longitudinal direction, the starboard row of grooves being laterally offset from the longitudinal centerline and from the starboard upper edge, the grooves of the starboard row of grooves defining recesses in an outer surface of the hull;

a port upper edge disposed on a left side of the longitudinal vertical plane;

a port portion extending between the keel and the starboard upper edge;

the port portion having a port row of grooves, the port row of grooves extending in the longitudinal direction, the port row of grooves being laterally offset from the longitudinal centerline and from the port upper edge, the grooves of the port row of grooves defining recesses in the outer surface of the hull; and a transom disposed between the starboard and port portions at a stern of the hull;

the hull having:

a length ranging from 2 meters to 4 meters;

a beam ranging from 0.75 meters to 1.5 meters; and a depth ranging from 0.25 meters to 1 meter, each groove of the starboard and port rows of grooves having a proximal end and a distal end, the proximal end being closer to the longitudinal centerline than the distal end; and for at least some grooves of each of the starboard and port rows of grooves the distal ends being disposed longitudinally forward of their corresponding proximal ends.

18. The personal watercraft hull of claim 17, wherein, for each groove of the at least some grooves, a vertical plane containing the proximal and distal ends of the groove is at an angle ranging from 20 degrees to 60 degrees from the longitudinal vertical plane.

19. A personal watercraft hull comprising:

a bow;

a keel extending along a longitudinal centerline of the hull;

a starboard upper edge disposed on a right side of a longitudinal vertical plane containing the longitudinal centerline;

a starboard portion extending between the keel and the starboard upper edge, the starboard portion having a starboard region having recessed features, the starboard region extending in a longitudinal direction, the starboard region being laterally offset from the longitudinal centerline and from the starboard upper edge, the recessed features of the starboard region defining recesses in an outer surface of the hull;

a port upper edge disposed on a left side of the longitudinal vertical plane;

a port portion extending between the keel and the starboard upper edge;

the port portion having a port region having recessed features, the port region extending in the longitudinal direction, the port region being laterally offset from the longitudinal centerline and from the port upper edge, the recessed features of the port region defining recesses in the outer surface of the hull; and a transom disposed between the starboard and port portions at a stern of the hull;

the hull having:

a length ranging from 2 meters to 4 meters;

a beam ranging from 0.75 meters to 1.5 meters; and a depth ranging from 0.25 meters to 1 meter, the recessed features of the starboard region and the port region being shaped and located on the hull such that for a personal watercraft having the hull;

during straight line operation above a predetermined speed, the bow is tilted up relative to the transom and the starboard and port regions having recessed features are above water;

during a starboard turn, a majority of the starboard region having recessed features is below water to apply a downward force on the starboard portion, and the port region having recessed features is above water; and during a port turn, a majority of the port region having recessed features is below water to apply a downward force on the port portion, and the starboard region having recessed features is above water.

20. The personal watercraft hull of claim 19, wherein:

the starboard region having recessed features is a starboard row of grooves; and the port region having recessed features is a port row of grooves.

21. The personal watercraft hull of claim 20, wherein, for each of the starboard and port rows of grooves, the row has:

a laterally inner side disposed at a first lateral distance from the longitudinal centerline; and a laterally outer side disposed at a second lateral distance from the longitudinal centerline;

wherein:

the first lateral distance is at least 10 percent of the beam; and the second lateral distance is less than 40 percent of the beam.

* * * * *